United States Patent [19]

Parkinson et al.

[11] Patent Number: 4,947,491

[45] Date of Patent: Aug. 14, 1990

[54] PUMP

[75] Inventors: Brian Parkinson; Angus J. Bishop; Richard L. Tagg, all of York, United Kingdom

[73] Assignee: Portasilo Limited, Huntington York, United Kingdom

[21] Appl. No.: 114,450

[22] Filed: Oct. 28, 1987

Related U.S. Application Data

[63] Continuation-in-part of Ser. No. 80,466, Jun. 3, 1987, abandoned.

[30] Foreign Application Priority Data

Jun. 27, 1987 [GB] United Kingdom ..... 8715150

[51] Int. Cl.[5] ..... E03D 1/00

[52] U.S. Cl. ..... 4/321; 4/317; 4/308; 4/410; 417/472

[58] Field of Search ..... 4/317, 318, 663, 664, 4/308, 321, 323, 345, 378, 393, 395, 396, 407, 410, 411, 429, 602, 603, 625, 626, 251; 417/472, 559, 569, 328, 329; 210/167, 416.1, 258, 196; 92/134, 85 B, 85 R, 181 P, 181 R

[56] References Cited

U.S. PATENT DOCUMENTS

| | | | |
|---|---|---|---|
| 193,145 | 7/1877 | Collins | 417/472 |
| 859,914 | 7/1907 | Buder | 417/472 |
| 2,943,577 | 7/1960 | Barker . | |
| 2,953,223 | 9/1960 | Dillenburger et al. | 92/181 R |
| 3,180,566 | 4/1965 | Murat et al. . | |
| 3,501,778 | 3/1970 | Minniear et al. | 4/317 |
| 3,634,891 | 1/1972 | Kemper | 4/317 |
| 3,662,888 | 5/1972 | Kemper | 4/318 |
| 3,818,806 | 6/1974 | Fumagalli | 417/472 |
| 3,860,974 | 1/1975 | DeVries et al. | 4/321 |
| 4,028,747 | 6/1977 | Newton | 4/317 |
| 4,091,488 | 5/1978 | Artzberger | 92/181 P |
| 4,162,549 | 7/1979 | Charles et al. | 4/317 |
| 4,313,233 | 2/1982 | Roberts | 4/317 |

FOREIGN PATENT DOCUMENTS

| | | |
|---|---|---|
| 498584 | 3/1979 | Australia . |
| 501790 | 6/1979 | Australia . |
| 507516 | 2/1980 | Australia . |
| 547908 | 11/1985 | Australia . |
| 0194417 | 1/1986 | European Pat. Off. . |
| 3101935 | 8/1982 | Fed. Rep. of Germany . |
| 4941 | of 1915 | United Kingdom . |
| 939529 | 10/1963 | United Kingdom . |
| 1395118 | 5/1975 | United Kingdom . |
| 1569155 | 5/1980 | United Kingdom . |
| 2033470A | 6/1980 | United Kingdom . |

*Primary Examiner*—Linda J. Sholl

[57] ABSTRACT

A pump comprising a flexible member defining at least part of a variable volume pumping chamber, an inlet valve to permit of liquid to enter the chamber thereby and an outlet valve to permit of liquid to leave the chamber thereby, and an operating member to deform the flexible member to vary the volume of the pumping chamber to pump liquid into and out of the chamber.

16 Claims, 4 Drawing Sheets

10'
60'
56'
57'
58'
74
26'
11a'
9
27'a
20a
78
73
77
72
76
54'
20a
26a'
75
80
81
79
43'
59'
32'
52'
-23-
24'
42'
53'
40'
-22-
74a
51'
41'
50'
36'
34'
37'
31'
33'
30'
35'
71
71
20'
11
11b'
70
21'

PUMP

RELATED U.S. APPLICATION DATA

This is a Continuation in Part of our copending application Ser. No. 080466 filed 3 Jun. 1987 now abandoned.

BACKGROUND TO INVENTION

This invention relates to a pump particularly, but not exclusively, for pumping liquid to flush a sanitary pan or for pumping water to a discharge means associated with a sink for hand washing purposes or to a shower head. The invention also relates to a reservoir and a pump in combination to provide a self-contained liquid or water supply and pumping capability. The invention also relates to cabins, huts and like accommodation units housing at least one sanitary pan and/or sink and/or shower head for use on building sites, exhibition grounds, camp site car parks and the like, i.e. in all manner of circumstances where sanitary facilities of a permanently installed nature are not available but where such facilities must nevertheless be provided for use of site workers and others, and provided with a pump for pumping liquid to flush the sanitary pan or to pump water to a discharge means associated with the sink, or to the shower head.

SUMMARY OF THE INVENTION

According to a first aspect of the invention we provide a pump comprising a flexible member defining at least part of a variable volume pumping chamber, an inlet valve to permit liquid to enter the chamber thereby and an outlet valve to permit liquid to leave the chamber thereby, and operating means to deform the flexible member to vary the volume of the pumping chamber to pump liquid into and out of the chamber.

In one more specific aspect of the invention the pumping chamber may be disposed within a receptacle, the receptacle including a wall through which the operating means passes so that an operating member is disposed externally of the receptacle and the pumping chamber internally of the receptacle, and the receptacle is adapted to be positioned at least partly within a reservoir for liquid to be pumped and the receptacle is adapted to permit passage of liquid to the interior thereof from such reservoir.

The flexible member may be operatively connected to an operating member by an operating link whereby movement of the operating member causes movement of the flexible member to increase or decrease its volume.

The operating member may be arranged to move rectilinearly and be directly connected, by a rigid operating link, to the flexible member.

A resilient biasing means may be provided to return the flexible member to an initial condition after being deformed by the operating member to reduce the volume of the pumping chamber.

The resilient biasing means may act on the operating member or operating link.

Alternatively, the resilient biasing means may act on the flexible member and may comprise a coil compression spring disposed within the flexible member to act between the pump body and the flexible member.

The resilient biasing means, which conveniently comprises a coil compression spring, may be disposed in encircling relationship with the operating link and be disposed between the operating member and the wall of the receptacle.

The rigid link and resilient biasing means may be within a flexible sleeve.

Alternatively the resilient biasing means may comprise a fluid containing unit in which relative movement of solid elements of the unit occurs on movement of the flexible member from the initial condition is resisted by elastic deformation of the fluid and the resultant energy stored in the fluid causes movement of the solid elements to move the flexible member towards the initial condition.

Alternatively a guide means may be provided to guide the flexible member during said deformation, the guide means comprising first and second slidably related members, a first of said members being fixed to a base part of the pump to which the flexible member is also attached at one end and the operating means and the outer end of the flexible member being connected to the second member.

According to a second aspect of the invention we provide a pump comprising a flexible member defining at least part of a variable volume pumping chamber, an inlet valve to permit of liquid to enter the chamber thereby, an outlet valve to permit of liquid to leave the chamber thereby, operating means to deform the flexible member from an initial condition and resilient biasing means to return the flexible member towards the initial condition to vary the volume of the pumping chamber to pump liquid into and out of the chamber wherein the resilient biasing means comprises a fluid containing unit in which relative movement of solid elements of the unit occurring on movement of the flexible member from the initial condition is resisted by elastic deformation of the fluid and the resultant energy stored in the fluid causes movement of the solid elements to move the flexible member towards the initial condition.

The fluid containing unit may comprise a chamber with a flexible wall or a piston and cylinder in mutual contact or a piston supported in a cylinder of substantially large diameter than the piston and sealed thereto by means of an over-sized annular diaphragm which performs a rolling motion during said relative movement of the solid elements of the unit.

The resilient biasing means may comprise first and second telescopically slidable members, a first of said members being fixed to a base part of the pump to which the flexible member is also attached at one end and the operating means and the other end of the flexible member being connected to the second member of the resilient biasing means.

The flexible member may be connected to the second member by an operating link which extends from the flexible member to a position adjacent the upper end of the second member adjacent which the operating link is connected to the operating member and to the second member.

According to a third aspect of the invention we provide a pump comprising a flexible member defining at least part of a variable volume pumping chamber, an inlet valve to permit of liquid to enter the chamber thereby, an outlet valve to permit of liquid to leave the chamber thereby and operating means to deform the flexible member to vary the volume of the pumping chamber to pump liquid into and out of the chamber wherein a guide means is provided to guide the flexible member during said deformation.

The guide means may guide the operating means.

The guide means may comprise first and second slidably related members, a first of said members being fixed to a base part of the pump to which the flexible member is also attached at one end and the operating means and the other end of the flexible member being connected to the second member.

The flexible member may be connected to the second member by an operating link which extends from the flexible member to a position adjacent the upper end of the second member adjacent which the operating link is connected to the operating member and to the second member.

The first and second slidably related member may be telescopically slidable one within the other.

Where the flexible member is connected to the second member by an operating link the second member may be telescopically slidable within the first member and the operating link may be telescopically disposed around the first member.

In the second and third aspects of the invention the pumping chamber may be disposed within a receptacle, the receptacle including a wall through which the operating means passes so that an operating member is disposed externally of the receptacle and the pumping chamber internally of the receptacle, and the receptacle is adapted to be positioned at least partly within a reservoir for liquid to be pumped and the receptacle is adapted to permit passage of liquid to the interior thereof from such reservoir.

In all aspects of the invention, the reservoir may be provided with an opening through which said receptacle extends and the opening being closed by the wall of the receptacle through which the operating means passes.

The receptacle may be replaceably mounted at least partly within said reservoir.

Accordingly it is simple to remove the pump, for example, for repair or servicing simply by removing the receptacle from the container.

The pump may be operatively connected to a sanitary pan to flush the pan with liquid withdrawn from a region of said reservoir which is separated by a filter screen from another region thereof into which the sanitary pan discharges.

Alternatively the pump may be connected to a discharge outlet associated with a sink for hand washing purposes to pump water to the discharge outlet. Further, alternatively, the pump may be connected to a shower head so as to pump water to the shower head.

The invention provides a self-contained liquid pumping facility which may be used in a wide variety of applications such as to flush a water closet (w.c.) or "head" in a boat or a w.c. in a coach, train, aeroplane or the like or to provide a water supply to a wash basin or shower in a boat, coach, train or aeroplane or the like. If desired the reservoir may comprise two reservoirs, the contents of which are kept separate and there being two pumps, one to pump liquid for w.c. sanitary pan flushing and the other to pump clean water for washing or showering.

The pump may be disposed in said reservoir so as to be at least partially immersed in the liquid, in use.

The flexible member may define at least a majority of the variable volume pumping chamber and the pump may be operatively connected to a sanitary pan so as to pump liquid to flush the pan.

The sanitary pan may be housed in a cabin, hut or like accommodation unit, the unit having a wall structure mounted on a base structure, the base structure defining the, or a, reservoir, the reservoir being for the reception of a suitable chemical liquid, and the sanitary pan being arranged to discharge into the liquid in use.

The receptacle may be provided with an imperforate wall on the side thereof adjacent to the discharge of the sanitary pan to the reservoir and is provided with a perforate wall, which comprises said filter screen, on the other side thereof.

Said filter screen may be arranged only to surround the inlet to the pump, the sanitary pan being arranged to discharge to a region external to said screen, which may be regarded as being on the "soil side" of the filter screen, whilst the inlet to the pump is disposed internally of filter screen and may be regarded as being on the "clear side" thereof.

Alternatively, said filter screen may be arranged to divide said chamber into two regions of comparatively large volume, the sanitary pan being arranged to discharge into one such region, which may be regarded as being on the "soil side" of the filter screen, whilst the inlet to the pump is disposed on the other side of the filter screen and may be regarded as being on the "clear side" thereof.

In either case, upon each operation of the pump to draw chemical liquid from the "clear side" of the reservoir such liquid will be replaced by liquid drawn through the filter screen from the "soil side" thereof.

The pump of the present invention, by virtue of being disposed so that it is at least partially immersed in the liquid in the tank and by arranging that the fluid level in the tank is at an appropriate level, an adequate amount of liquid to flush the sanitary pan can be achieved with one or, at most, two strokes of the operating member. Moreover, because the pump does not have a piston slidable within a cylinder, no problems arise due to jamming of the piston or of leakage due to wear or failure of a seal between the piston and cylinder. The pump is, therefore, extremely reliable and effective in use.

The reservoir for the chemical liquid forms part of the structure of the unit rather than being a separate fitting as when a conventional chemical closet is mounted in the structure in which it is to be employed; such an arrangement makes for simpler and thus cheaper construction.

A unit according to the invention may house more than one sanitary pan, in separate cubicles; in these circumstances each pan could, if desired, be associated with its own individual reservoir for chemical liquid or alternatively two or more pans could be associated with the same reservoir but in either case each pan would have its own pump.

In one embodiment of the invention which is a unit housing only one sanitary pan, the whole base structure of the unit is in the form of a hollow box defining said reservoir for the chemical liquid, the top closure of such box forming the floor within the unit and being provided with an opening through which said receptacle extends. The box as a whole constitutes a plinth-like base structure on which the wall structure of the unit is mounted. However, in larger units according to the invention housing two or more sanitary pans, and possibly other sanitary fittings such as urinals and wash basins in addition, the reservoir or reservoir into which such pans discharge need not necessarily occupy the whole of the base structure of the unit but rather may extend only between the cubicles containing the sanitary pans. Where the unit has only one sanitary pan it may be provided with a wash basin or urinal and a pump according to the invention may be provided to pump appropriate liquid thereto.

Means are provided for emptying the chamber at suitable intervals and such means may, if desired, comprise a discharge opening enclosed by a suitable valve mechanism within the chamber. An overflow pipe may be provided in said chamber having its inlet on the clear side of the filter screen and its outlet connected directly to the chamber emptying outlet. Means may be provided for heating the interior of the chamber to prevent freezing of the chemical liquid such as an electrical heater or a color gas or paraffin fuel heater.

The sanitary pan may be provided with a liquid seal in its discharge, for example, by providing a conventional U-bend in which liquid is trapped.

The pump of the present invention pumps sufficient liquid to permit of breaking of the seal provided by the U-bend so that a conventional flushing and sewage discharge operation is provided.

Alternatively, the sanitary pan may be provided with a flap valve in its discharge which flap valve is operable by the liquid pumped by the pump.

A suitable chemical liquid for use in units according to the invention is one such as is conventionally used in chemical closets, which functions both as a disinfectant and to breakdown solid excreta.

The pumping chamber may also be defined by a fixed volume rigid body on which the flexible member is mounted so as together to define the pumping chamber.

The rigid body may provide said base.

The inlet and outlet valves may be provided on the rigid body.

The inlet valve may comprise a flexible diaphragm movable into and out of sealing engagement with an inlet opening in a part of the body.

The outlet valve may comprise a valve member, such as a ball, movable into and out of sealing engagement with a valve seat surrounding an outlet opening in a part of the body.

The flexible member may be generally cylindrical having a generally cylindrical wall which may be closed at one end and open at the other where it is connected to the body.

The generally cylindrical wall may have a corrugated configuration to provide a collapsible bellows.

BRIEF DESCRIPTION OF THE DRAWINGS

Three embodiments of the invention will now be described by way of example with reference to the accompanying drawings in which.

DESCRIPTION OF THE PREFERRED EMBODIMENTS

Figure 1:
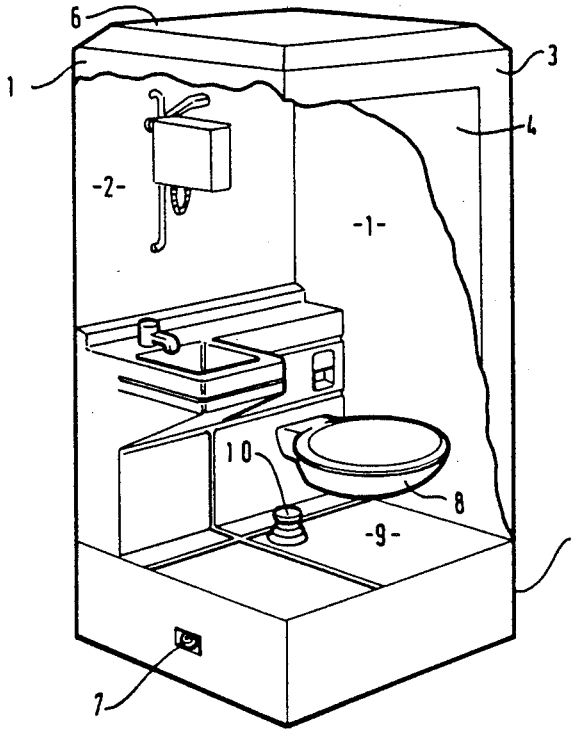
FIG. 1 is a perspective view of a unit according to the invention, in the form of a portable cabin.
Figure 2:
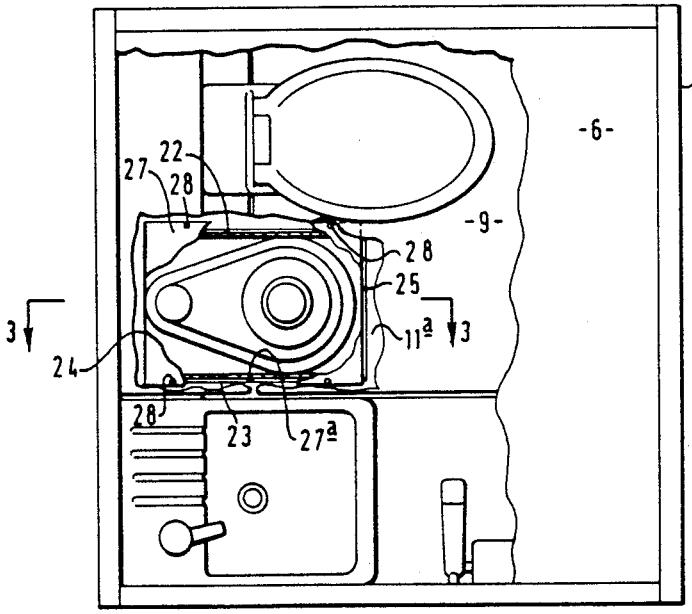
FIG. 2 is a plan view partly cut away to show part of the interior of the cabin of FIG. 1.

Referring first particularly to FIGS. 1 and 2 of the drawings, there is shown a unit according to the invention comprising a cabin about 2.3 meters high and 1.2 meters square having side walls 1, a rear wall 2 and a front wall 3 containing a door 4. The wall structure is mounted on a plinth-like base structure 5. The roof 6 of the unit is of a cup-like construction and is a one-piece moulding of plastics material which is sufficiently translucent for natural light to illuminate the interior of the cabin when the door is closed. The cabin is provided with lifting means in the form of eye bolts 7 provided at opposite sides of the base.

The cabin houses a sanitary pan 8 mounted above a floor 9. Flushing of the sanitary pan is effected by operation of a foot pedal 10 to actuate a pump to be described below.

Figure 3:
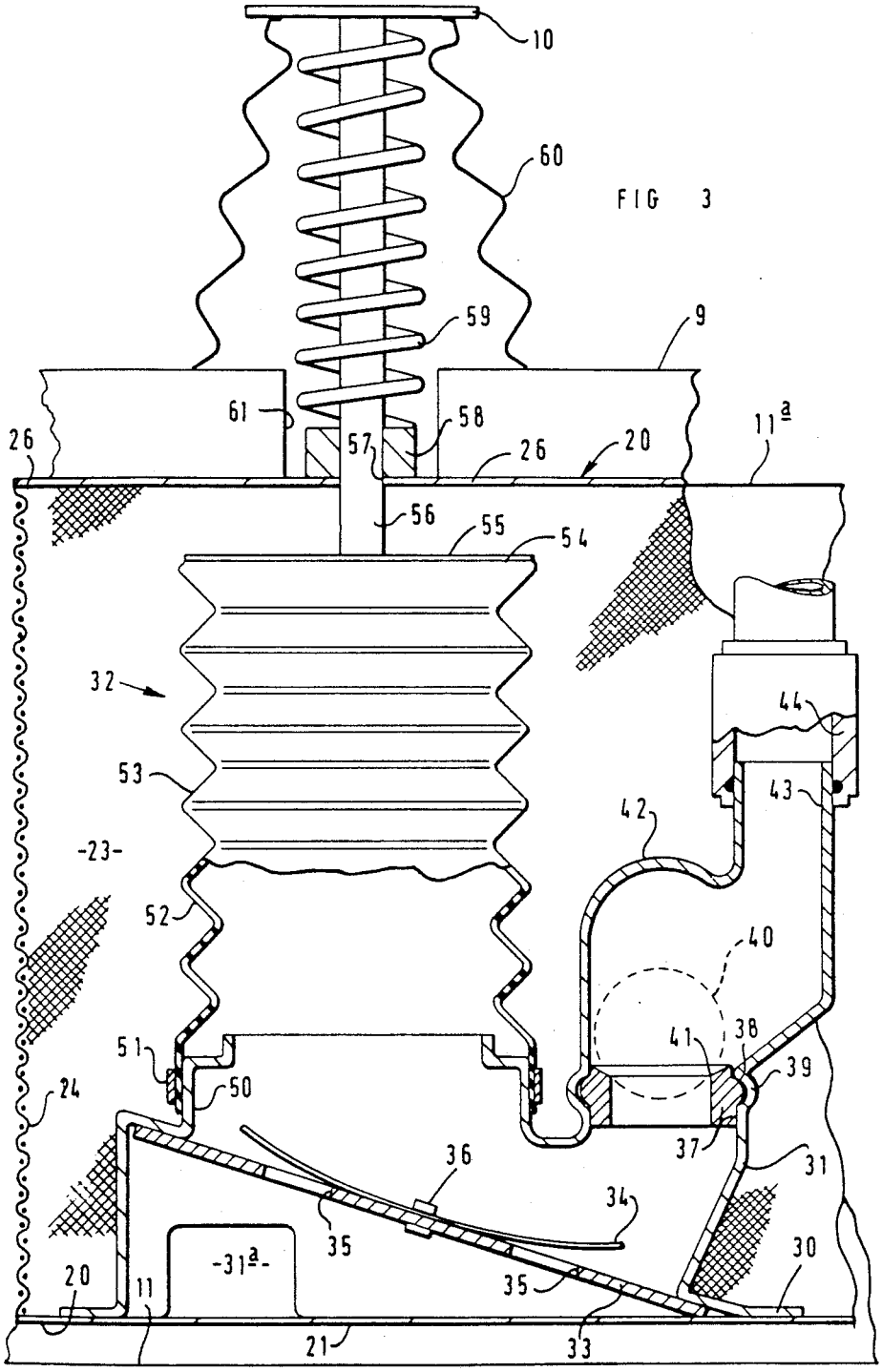
FIG. 3 is a cross-section on the line 3—3 of FIG. 1.

Referring now to FIGS. 2 and 3 in particular, the plinth-like base structure 5 of the unit is in the form of a watertight box moulded in thermo setting plastics material such as reinforced polyester resin and providing an enclosed chamber or reservoir 11 capable of receiving a suitable chemical liquid which will receive the discharge from the sanitary pan 8 and will also be used to flush the pan. The floor 9 of the unit is provided by separate floor panels above the top of the reservoir 11 and the foot pedal 10 for operating the pump is mounted for vertical sliding movement as hereinafter to be described. The pump is provided within a receptacle 20 made as a fabrication in steel. The receptacle may be made in other material such as a suitable plastics material.

The receptacle is of generally rectangular box configuration having a bottom wall 21, opposed side walls 22, 23, opposed end walls 24, 25 and a top wall 26. The top wall 26 projects outwardly of the side walls 22, 23 to provide flanges 27 which overlie two opposite sides of an opening **27*a* provided in the top wall 11*a* of the reservoir 11 to which the flanges are secured by fasteners 28. The receptacle is thereby replaceably mounted with a majority thereof within the reservoir and can therefore be quickly and easily removed from the reservoir 11 simply by undoing the fasteners 28** and lifting the receptacle and a pump associated therewith, hereinafter to be described, therefrom.

The side wall 23 and two opposed end walls 24, 25 are made of a suitable filter mesh material whilst the base wall 21 and other side wall 22 are imperforate.

Fixed to the base wall 21 is an outwardly extending flange 30 of a rigid body part 31 of a pump 32. The body part 31 is made as a moulding in a suitable synthetic plastics material such as polyethylene.

A rectangular opening is formed in the side wall of the body 31 as shown at **31*a* which provides a liquid entry opening and a perforated plate 33 extends across the interior of the pump body part 31 at an angle of approximately 18° to the horizontal and is provided with a circular diaphragm 34 of P.V.C. which is provided with a permanent bias away from openings 35 in the plate 33 and is secured to the plate 33 by a rivet 36. The diaphragm 34** is such that it can be deformed into sealing engagement with the plate around the opening 35 by the application of pressure to the diaphragm, as hereinafter to be described.

The pump body part 31 is provided with an outlet opening 37 in which a ball seat insert 37 made of polypropylene, maintained by engagement of a rib 38 formed thereon in a groove 39. A valve member 40 in the form of a ball is provided which is movable into sealing engagement with a seat 41 provided on the insert 37. The ball 40 is maintained in position by a housing 42 provided with an outlet pipe 43 which is connected to a flush pipe 44 of the sanitary pan 8.

The pump body part 31 is provided with a generally cylindrical portion 50 to which is clamped, by a clamp ring 51, a flexible bellows 52 made of P.V.C. The bellows 52 is of generally cylindrical configuration having a generally cylindrical wall 53 of corrugated configuration to provide a collapsible bellows and a closed top wall 54 which is connected to a plate 55 from which an operating rod or link 56 extends vertically upwardly through an opening 57 in the top wall 26 of the receptacle 20. The top wall 26 is provided with a bearing 58 to guide the rod 56 for vertical sliding movement. The bellows 52 provides a majority of variable volume pumping chamber the remainder of which is defined by the pump body part 31. A coil compression spring 59 encircles the rod 56 and is engaged between the plate 26 and foot pedal 10 so as resiliently to bias the foot pedal 10 upwardly and hence to return the bellows 52 to an original position of greater volume after compression of the bellows to a smaller volume by pressing of the foot pedal 10. A flexible rod cover is provided around the rod 56 and spring 59 between the foot pedal 10 and the floor plate 9 which is apertured as shown at 61 to receive the rod 56 and spring 59.

In use, the valve body part 31 and at least a part of the bellows 52 will be immerseed in a chemical liquid within the reservoir 11. Pressing of the foot pedal 10 by a user with his foot will urge the rod 56 downwardly and hence compress the bellows to cause the diaphragm 34 to close the inlet opening 35 and to lift the ball 40 away from the seat 41 and thus to force the liquid contents of the pump chamber through the feed pipe 44 to flush the sanitary pan 8. The pump mechanism is dimensioned in relation to the usual level of liquid in the reservoir 11 so that one or two operations of the foot pedal 10 will be sufficient to cleanse the pan in normal circumstances. When the user lifts his foot from the pedal the spring 59 returns the pedal, and hence the bellows, to its original position to cause the ball valve 40 to move into sealing engagement with the seat 41 and the diaphragm 34 to move away from the inlet opening 35 so that liquid is drawn into the pump chamber through the opening 35 and entry opening 32.

So as to ensure that only chemical liquid free of solid matter is supplied to the sanitary pan 8 for flushing the latter, the hereinbefore mentioned filter mesh is provided on the sides 23, 24 and 25 of the receptacle 20 and the receptacle 20 is orientated so that the imperforate side 22 is adjacent to the waste discharge of the sanitary pan 8. As a result liquid delivered via the pump mechanism will be free of solid matter. If desired, an additional screen or screens may be provided externally of the receptacle 20 to divide the reservoir 11 into two regions, one of which contains the receptacle 20 and the other of which contains the outlet of the discharge pipe of the sanitary pan 8.

The reservoir 11 is provided with a means for emptying the chamber comprising a valve member associated with a discharge tube at the bottom rear of the reservoir 11. The valve mechanism may be of any convenient type and is not illustrated herein.

Similarly the reservoir is provided with an overflow pipe, the inlet end of which is positioned adjacent the top of the chamber and is connected to the hereinbefore mentioned discharge tube at its other end.

The unit incorporates heating means for use in cold weather to prevent freezing of the liquid in the reservoir 11. The heating means takes the form of an immersion heater (not shown) whose head is housed in a compartment connected to the rear wall of the base structure having an exit door, not shown. The heating element of the immersed in the liquid. The compartment remains sufficiently large to accommodate alternative heating means, such as a color gas burner or paraffin lamp.

The sanitary pan 8 can be a standard vitreous china flushing pan with bottom outlet which discharges directly through an aperture in the floor 9 of the unit into the reservoir 11. The sanitary pan 8 has a conventional U-bend so as to provide a liquid seal between the flushing pan and the reservoir 11. The unit may be arranged to house further fittings such as a storage tank for the supply of water to a wash basin if fitted and a hand dryer or container for paper towels. If a wash basin is fitted to a pump similar but, if desired, of smaller size to the pump hereinbefore described may be provided to pump water from the storage tank to a discharge outlet associated with the sink for hand washing purposes.

The unit may be arranged to house a shower and again a pump similar to that described hereinbefore may be used to pump water from a storage tank to a shower head.

Figure 4:
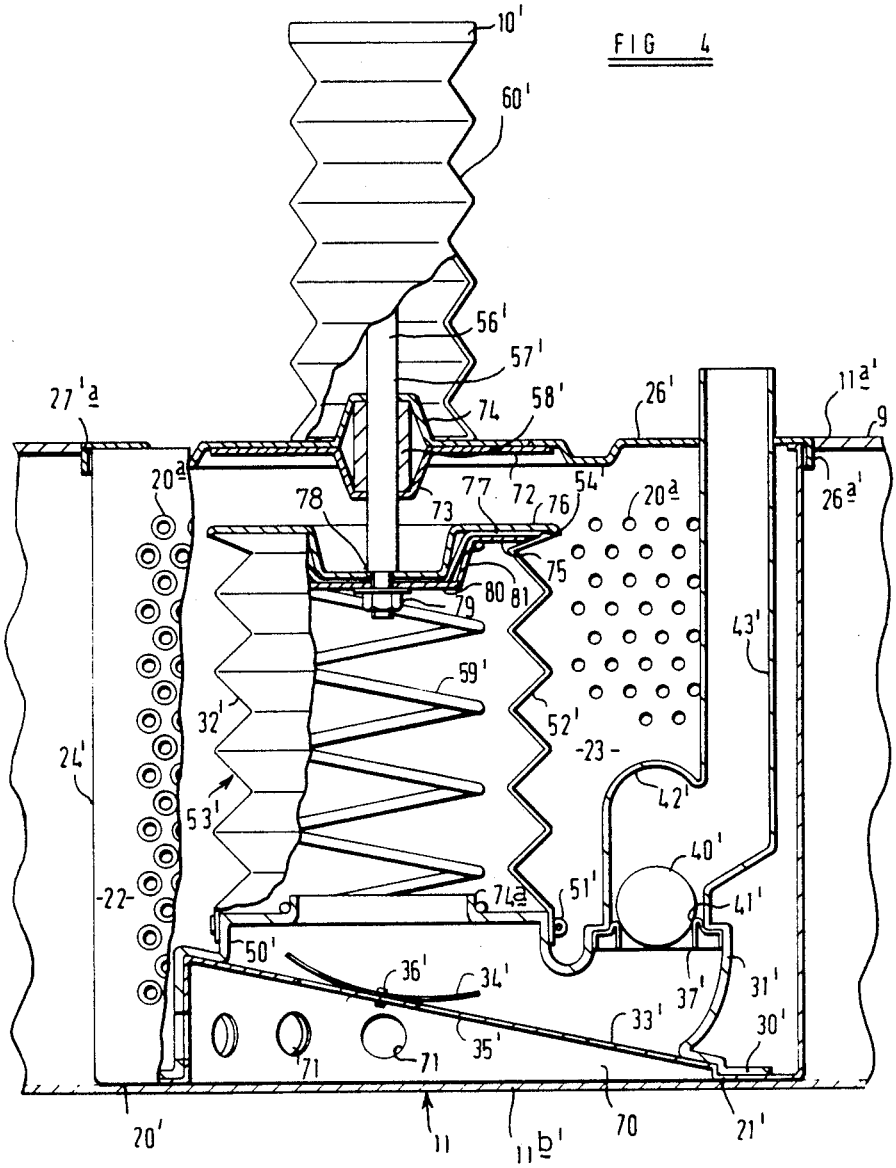
FIG. 4 is a cross-sectional view similar to that of FIG. 3 but showing a modification of the embodiment described with reference to FIGS. 1 to 3.

Referring now to FIG. 4 there is illustrated to a modification of the pump of the embodiment described with reference to FIGS. 1 to 3. In this modification the unit is as described with reference to FIGS. 1 and 2 of the drawings except that the floor 9' is provided by an upper polyester resin wall **11*a*', of the reservoir 11'. In FIG. 4 the same reference numerals have been used for the same parts as were used in FIGS. 1 to 3, but with the addition of a prime sign. In this modification a pump 32' is provided within a receptacle 20' made as a moulding in medium density polyethylene perforated as shown at 20*a*. In this embodiment the function of the perforated plate 33 shown in FIG. 3 is afforded by a correspondingly inclined part 33' moulded integrally with the remainder of the receptacle 20' and a circular diaphragm 34' of P.V.C. which is provided with a permanent bias away from openings 35' provided in the part 33' and is secured to the part 33' by a rivet 36'. As in the first embodiment the diaphragm 34' is such that it can be deformed into sealing engagement with the part 33' around the openihgs 35' by application of pressure to the diaphragm. The part of the receptacle 20' which provides a part cylindrical wall 70 depending downwardly from the part 33' is provided with openings 71 for the same function as the opening 31*a*** of the first embodiment.

A pump body part 31' essentially as described in connection with the first embodiment is mounted in the receptacle 20' in engagement with an up-stand provided by the wall 70 and part 33'. The pump body 31' is made as a moulding in medium density polythene and is secured to the receptacle 20' by suitable screws. In this embodiment the valve seat 41' is of the configuration shown in FIG. 4 and is provided on an insert 37' which is a generally channel shaped moulding of ABS. The valve member 40′ is made of medium density polyethylene and is filled with sand to provide the desired mass.

The top of the receptacle 20′ is closed by a top wall part 26′ having a downwardly depending peripheral flange 26a′ which flange is secured, for example by self tapping screws, to the overlapped part of the side wall of the receptacle 20′.

In this embodiment the receptacle 20′ rests on the base wall 11b′ of the reservoir 11 and the walls of the opening 27′a serve to hold the receptacle 20′ from lateral movement. Thus pumping loads are transmitted to the base wall 11b′.

Secured by suitable means such as rivets or screws to the underside of the wall 26′ is a bearing retaining plate 72 having a pocket 73 which co-operates with a similar but upturned pocket 74 provided in the top wall 26′ between which is received a nylon bearing bush 58′ which guides an operating rod 56′ in a similar manner to the bearing 58 of the embodiment described with reference to FIGS. 1 to 3. In this embodiment no coil compression spring corresponding to the coil compression spring 59 is provided to encircle the rod 56 and the flexible rod cover 60′ merely rests against the upper surface of the top wall 26′ due to its inherent resilience.

In place of the coil compression spring 59 encircling the rod 56 is provided a larger diameter coil compression spring 59′ which is disposed within the bellows 52′ and acts between the valve body 37′, being located around an upstanding circular flange 74a thereof, and a bottom bellows plate 75 which co-operates with a top bellows plate 76 to clamp the top part 77 of the bellows 52′ therebetween by virtue of engagement of the top bellows plate 76 with a shoulder 78 provided on the rod 56′ as a result of clamping action provided by a nut 79 and washer 80 threadedly engaged with the end of the rod 56. The bellows and bellows plate 75, 76 are formed to provide a frustoconical downwardly depending part 81 engaged within the upper end of the spring 59′ to retain the spring in position. The spring 59′ is preferably made of stainless steel to resist corrosion.

The top and bottom plate 75, 76 are made of ABS and the bellows 52′ and the rod cover 60′ are made of plasticised PVC.

In this embodiment the outlet pipe 43′ of the housing 42 extends through the top walls 26′ of the receptacle 20′ and is available for connection to a flush pipe of the sanitary pan 8 similarly to the flush pipe 44 described with reference to FIGS. 1 to 3.

In all other respects the pump is as described with reference to FIGS. 1 to 3 as is its mode of operation. The above described differences facilitate manufacture of the pump particularly moulding of the enclosure in medium density polyethylene and the positioning of the spring 59′ within the bellows 52′ permits of the use of the larger diameter spring so that a greater restoring force can be achieved whilst retaining a spring rate which is acceptable to a user. It has been found in practice that is not necessary to gain access to the spring for servicing frequently and if access is necessary it can be relatively easily gained simply by releasing the clamp ring 51′. It should be appreciated that the enclosure 20′ and pump 32′ mounted therein provide a sub-assembly which can be easily and conveniently removed from the reservoir 11.

Figure 5:
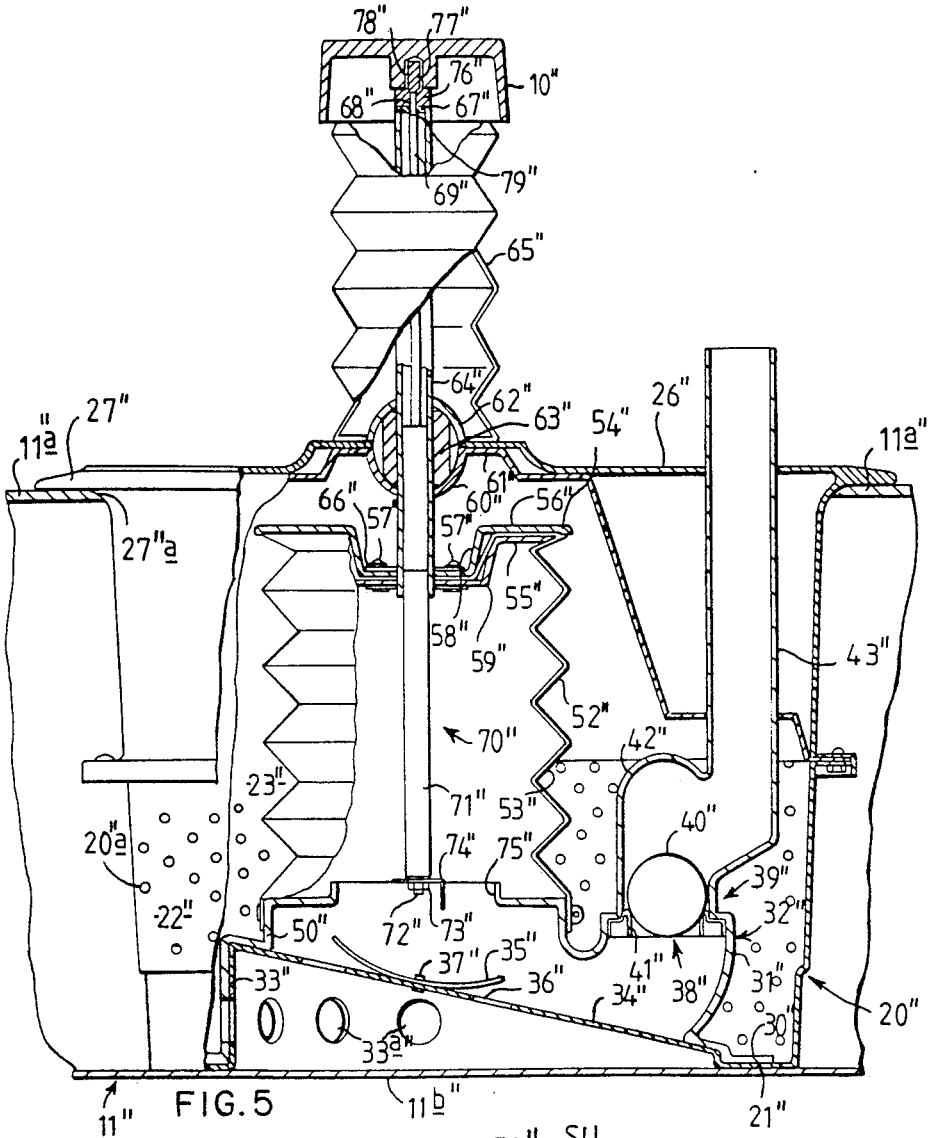
FIG. 5 is a cross-sectional view similar to that of FIG. 3 but showing another modification of the embodiment described with reference to FIGS. 1 to 3.
Figure 6:
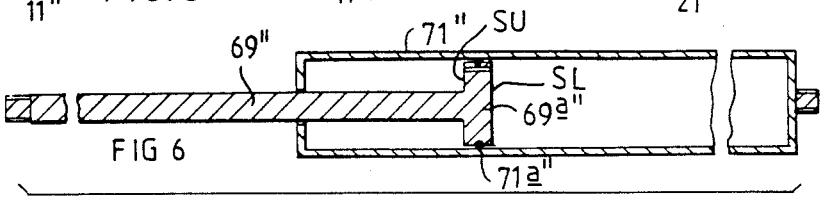
FIG. 6 is fragmentary longitudinal section, to an enlarged scale, showing the interior of the gas spring of FIG. 5.

Referring now to FIG. 5, there is illustrated another modification of the pump of the embodiment described with reference to FIGS. 1 to 3. In FIG. 5 the same reference numerals have been used for the same parts as were used in FIGS. 1 to 3 but with the addition of a double prime sign (″). In this modification the unit is as described with reference to FIGS. 1 and 2 of the drawings except that, as in the case of the FIG. 4 modification, the floor 9″ of the unit is provided by an upper polyester resin wall 11a′ and the foot pedal 10″ for operating the pump is mounted for vertical sliding movement as hereinafter to be described.

The pump 32″ is also similar to that of the FIG. 4 modification but is provided within a receptacle 20″ made as two separate mouldings, in ABS, medium density polyethylene or other suitable material, which are bolted together. The receptacle may be made in any other suitable material such as a suitable steel, or of other configuration, such as described hereinbefore, if desired. The receptacle is again of generally rectangular box configuration having a bottom wall 21″, opposed side walls 22″, 23″, and opposed end walls 24″, 25″. The parts of the side walls 22″, 23″ provided by the lower moulding are apertured as shown at 20a″. The top of the receptacle 20″ is closed by a top wall part 26″ formed integrally with the upper of the two mouldings which together comprise the receptacle.

The receptacle 20″ is received within an opening 27a″ in the top wall 11a″ of the reservoir 11″ and rests on a base wall 11b″ of the reservoir so that pumping loads are transmitted to the base wall 11b″. The walls of the opening 27a″ cooperate with an outwardly extending flange 27″ of the receptacle 20″ and together with self tapping screws connecting the flange 27″ to the top wall 11a″, serve to hold the receptacle 20″ from lateral movement. The receptacle is thereby replaceably mounted with a majority thereof within the reservoir and can be quickly and easily removed from the reservoir 11″ simply by lifting the receptacle and the pump 32″ therein out of the reservoir 11″. The side wall 23″ and two opposed end walls 24″, 25″ of the lower of the moulding which cooperate to provide the receptacle 20″ are perforated as shown at 20a″ whilst the base wall 21″ and the other side wall 22″ are imperforate.

Fixed to the base wall 21″ by self-tapping screws, or other fixing means is an outwardly extending flange 30″ of a rigid body part 31″ of the pump 32″. The body part 31″ is made as a moulding in a suitable synthetic plastics material such as polyethylene. The pump body part 31″ is mounted in the receptacle 20″ in engagement with an upstand provided on the base wall 21″ thereof. The upstand comprises a part cylindrical wall 33″ provided with openings 33a″ and an inclined part 34″ moulded integrally with the remainder of the receptacle 20″. A circular diaphragm 35″ of PVC, which is provided with an permanent bias away from openings 36″ provided in the part 34″ is secured to the part 34″ by a rivet 37″ or by other suitable means. The diaphragm 35″ is such that it can be deformed into sealing engagement with the part 34″ around the openings 36″ by the application of pressure to the diapragm.

The pump body 31″ is provided with an outlet opening 38″ provided with a ball valve 39″ comprising a ball 40″ sealingly engagable with a ball seat 41″ provided on a ball seat insert 42″ made of ABS. The ball 40″ is made of medium density polyethylene and is filled with sand to provide the desired mass. The ball 40″ is maintained in position by a housing 42″ provided with an outlet pipe 43″ which is connected to a flush pipe of the sanitary pan 8″.

The pump body part 31″ is provided with a generally cylindrical portion 50″ to which is clamping ring 51″, a flexible bellows 52" made of plasticised PVC. The bellows 52" is of generally cylindrical configuration having a generally cylindrical wall 53" of corrugated configuration to provide a collapsible bellows and a closed top wall 54" which is trapped between a bottom bellows plate 55" and a top bellows plate 56" which are tightened onto the top wall 54" by four nuts and bolts 57".

The bellows plates 55" and 56" are each provided with a fusto-conical recess 58", 59" respectively to accommodate a pocket part 60" of a bearing retaining plate 61" which is clamped between the two mouldings of the receptacle 20". The pocket part 60" cooperates with a similar pocket part 62" provided in the top wall 26" to house a nylon bearing bush 63" which guides an operating link 64" for vertical sliding movement.

The bellows 52" provides the majority of a variable volume pumping chamber the remainder of which is defined by the pump body part 31".

A flexible operating link cover 65" in the form of a flexible bellows made of plasticised PVC is provided around the operating link 64" and at its lower end is secured to the top wall 26" and its upper end is secured to the operating member or foot pedal 10".

The operating link 64" is connected at its lower end by welding to a circular flange 66" which is clamped to the bellows 55", 56" by the screws 57". At its upper end the operating link 64" has a transversely extending wall 67" which receives a threaded spigot 68" extending from a second member 69" of a gas spring 70". The first member 71" of which has a threaded spigot 72" connected by a nut 73" to a bracket 74" disposed in an opening 75" of the body part 31" of the pump so that the gas spring 70" extends upwardly centrally of the opening 75". The spigot 67" is threadedly received in a threaded bore of a connecting member 76" having a threaded spigot 77" which is threadedly received in a bore 78" of the foot pedal 10" so that the wall 67" of the connecting link 64" is trapped between the connecting member 76" and a shoulder 79" between the second member 69" and the spigot 68".

The connecting link 64" is of generally cylindrical configuration and is in telescopic sliding engagement with the first member 71" of the gas spring. The first member 71" of the gas spring is likewise in telescopic sliding engagement with the second member 69" thereof and within the first member 71" the second member 69" is provided with a piston 69*a*" which is in sliding and sealing engagement, by virtue of an 'O' ring 71*a*", with the interior of the first member 71".

A small amount of oil is provided within the first member 71" to lubricate the 'O' ring 71*a*" and provide damping to gas flow through a small diameter passage 69*b*" which extends between oppositely facing surfaces of the piston 69*a*". The interior of the first member 71" is filled with a suitable gas, such as nitrogen, so that as the second member 69" is moved downwardly by applying pressure to the pedal 10" to deform the bellows 53" from an initial condition shown in FIG. 5 the gas is forced through the passage 69*b*" in the piston 69*a*" to equalise the pressure on both sides of the piston. The gas is compressed by the reduction in the volume inside the first member 71" on the upper side of the piston 69*a*" due to the volume occupied by the second member 69". When operating pressure is lifted from the foot pedal 10" the pressure of the gas acting on the lower surface Sl of the piston 69*a*", which is of larger area than the annular upper surface Su of the piston 69*a*" creates a differential pressure which forces the piston 69*a*" upwardly to move the second member 69" upwardly to the bellows 53" back towards the initial condition. The gas passes through the passage 69*b*" in the piston 69*a*" to equalise the pressure on both sides of the piston ready for movement of the second member 69" downwardly again by the application of pressure to the foot pedal 10".

The embodiment of FIG. 4 is used in the same way as the previously described embodiments.

It has been found in practice that it is not necessary to gain access to the gas spring for servicing frequently and if access is necessary it can be relatively easily gained simply by releasing the clamp 5". It should be appreciated that the enclosure 20" and pump 32" mounted therein provide a sub-assembly which can be easily and conveniently removed from the reservoir 11.

A pump of the present embodiment has the following advantages:

by using a gas spring the spring force resisting movement of the pedal is constant throughout the stroke unlike a coil spring arrangement when the spring force would increase as the pedal is depressed; the fixing of the bottom end of the gas spring facilitates guiding of the movement of the foot pedal and results in a more rigid arrangement; there are fewer moving parts thereby extending the life between services; and servicing is simplified since the pump assembly can be easily removed and replaced simply by removing and replacing the receptacle as described above. All the components are more easily accessible for service and test, there is no need to drain the contents of the chamber in order to service the pump, because the whole of the pump can be removed for servicing and then replaced from the top of the chamber. This avoids loss of fairly expensive sanitary fluid, which is particularly important when the tank has been recently recharged and little used.

If desired a guiding arrangement for the operating means may be provided without providing a gas spring. For example, a coil compression spring could be provided between the lower bellows plate 59" and the opposed surface of the pump body 31", the recess 59" serving to centre the spring, and instead of telescopically engaging the operating link 64" around the first member of a gas spring it could be telescopically engaged around a guide member fixed at its lower end of a bracket corresponding to the bracket 74".

Further alternatively, if desired the coil spring in this embodiment could be provided within the link cover 65" instead of the pump bellows 52".

Further alternatively, even when a gas spring is provided additional coil compression spring means may be provided either within the bellows 52" and/or the link cover 65".

If desired, in all embodiments, instead of a water trap provided in the U-bend of a conventional sanitary pan the sanitary pan may be provided with a flap valve operable by the water pumped by the pump.

Although in the illustrated embodiments the top wall 26, 26", 26" of the receptacle effectively closes the top of the receptacle, except for a passage just large enough for the operating means to pass therethrough, if desired the top wall may be of lesser extend and may only comprise the top edge of the side wall of the receptacle. In this case other means such as the floor of the unit or a separate member may obturate the top of the receptacle, suitable means being provided for guiding the operating member.

It is particularly envisaged that the pump be provided in combination with a container to provide a reservoir for liquid to be pumped. The reservoir and pump combination may be provided to pump sanitary liquid to flush a sanitary pan such as a w.c. or "heads" in a boat or a w.c. in a coach, plane train or the like. In such applications the builder of the boat, train, coach, plane or the like would provide the sanitary pan and all the other fittings required in the relevant part of the boat etc, and a pump and reservoir combination according to the present invention would be connected in position. Alternatively, if desired, the sanitary pan may be supplied in combination with the pump and reservoir combination to provide a self-contained unit to be received by suitable prepared area of the boat etc.

Alternatively, the reservoir may, in use, be connected to a wash basin or shower or the like to supply clean water thereto.

Further alternatively, the reservoir may be divided into two separate reservoirs, one providing liquid for flushing a sanitary pan with one pump according to the first aspect of the invention and the other reservoir containing clean water and a second pump according to the first aspect of the invention to provide water for washing or showering or the like.

Although in the previously described embodiments the reservoir has been described as being provided as part of the base plinth of the unit if desired the reservoir may be provided as an upstand on the floor of the unit or other area in which the combination is provided.

A pump embodying the present invention has the following advantages:

There are fewer moving parts, thereby extending the life between services; servicing is simplified since the pump assembly can be easily remove and replaced simply by removing and replacing the receptacle as described above. Therefore all the components are more easily accessible for service and test, there is no need to drain the contents of the chamber in order to service the pump, because the whole of the pump can be removed for servicing and then replaced from the top of the chamber. This avoids loss of fairly expensive sanitary fluid, which is particularly important when the tank has been recently recharged and little used.

If desired the flexible member which defines a majority of the variable volume pumping chamber may be of other configuration to the generally cylindrical bellows configuration described herein so long as it pumps a sufficient volume of liquid as described hereinbefore.

The features disclosed in the foregoing description, or the following claims, or the accompanying drawings, expressed in their specific forms or in terms of a means for performing the disclosed function, or a method or process for attaining the disclosed result, or a class or group of substances or compositions, as appropriate, may, separately or any combination of such features, be utilised for realising the invention in diverse forms thereof.

We claim:

1. A pump and a reservoir in combination, the pump comprising a wall defining a variable volume pumping chamber, at least a major part of the wall comprising a flexible bellow member and a minor part of the wall comprising a rigid member and said chamber having an inlet valve to permit liquid to enter the chamber thereby and an outlet valve to permit liquid to leave the chamber thereby, and operating means to deform the flexible member to vary the volume of the pumping chamber to pump liquid into and out of the chamber, the wall defining the pumping chamber being formed separately from and mounted within a receptable with a sub-chamber therebetween and the inlet valve being in liquid extracting relationship with said sub-chamber, the receptacle including a wall through which the operating means passes so that a manually engageble operating member is disposed externally of the receptacle and the wall defining the pumping chamber being disposed within the reservoir internally of the receptacle, the reservoir comprising an opening through which said receptacle extends and the opening being closed by the receptacle, the receptacle, being replaceably mounted at least partly within the reservoir and the receptacle being adapted to permit passage of liquid to the sub-chamber from said reservoir.

2. A pump according to claim 1 the pump is operatively connected to a sanitary pan to flush the pan with liquid withdrawn from a region of said reservoir which is separated by a filter screen from another region thereof into which the sanitary pan discharges.

3. A pump according to claim 2 wherein the sanitary pan is housed in an accommodation unit, the unit having a wall structure mounted on a base structure, the base structure defining the, or a, reservoir, the reservoir being for the reception of a suitable chemical liquid, and the sanitary pan being arranged to discharge into the liquid in use.

4. A pump according to claim 3 wherein the unit houses only one sanitary pan and the whole base structure of the unit is in the form of a hollow box defining said reservoir for the chemical liquid, the top closure of such box forming the floor, within the unit and being provided with an opening through which said receptable extends, the box as a whole constituting a plinth-like base structure on which the wall structure of the unit is mounted.

5. A pump according to claim 2 wherein the receptacle is provided a wall which defines an enclosure with an imperforate wall on the side thereof adjacent to the discharge of the sanitary pan to the reservoir and a perforate wall, which comprises said filter screen, on the other side thereof.

6. A pump according to claim 2 wherein the pump is disposed in said reservoir so as to be at least partially immersed in the liquid, in use.

7. A pump according to claim 2 wherein the sanitary pan is provided with a liquid seal in its discharge for a conventional U-bend in which liquid is trapped, and the pump is adapted to pump sufficient liquid to permit of breaking of the seal provided by the U-bend so that a conventional flushing and sewage discharge operation is provided.

8. A pump according to claim 1 wherein the flexible member is generally cyclindrical corrugated having a generally cylindrical wall which is closed at one end and open at the other where it is connected to a body.

9. A pump according to claim 1 wherein said operating means includes a rigid operating link extending between said operating member and said flexible member and resilient biasing means to return the flexible member towards an initial condition, the resilient biasing means comprises a fluid containing unit in which relative movement of solid elements of the unit occurs on movement of the flexible member from the initial condition is resisted by elastic deformation of the fluid and the resultant energy stored in the fluid causes movement of the solid elements to move the flexible member towards the initial condition.

10. A pump according to claim 9 wherein said resilient biasing means is disposed telescopically relative to said operating link and partially within said pumping chamber.

11. A pump according to claim 1 wherein a guide means is provided to guide the flexible member during said deformation, the guide means comprisng first and second slidably related members, a first of said members being located relative to a base part of the pump to which the flexible member is also attached at one end and the operating means and the other end of the flexible member being connected to the second member.

12. A pump according to claim 1 wherein said operating means includes a rigid operating link extending between said operating member and said flexible member and resilient biasing means to return the flexible member towards an initial condition, the resilient biasing means comprising a fluid containing unit having first and second slidably related solid members, relative movement therebetwen on movement of the flexible member from the initial condition by the operating link being resisted by elastic deformation of the fluid and the resultant energy stored in the fluid causing movement of the first and second members to move the flexible member towards the initial condition, and the first of said members being located relative to a base part of the pump to which the flexible member is also attached to one end and the operating link and the other end of the flexible member being connected to the second member.

13. A pump comprising a flexible member defining at least part of a variable volume pumping chamber, an inlet valve to permit liquid to enter the chamber thereby, an outlet valve to permit liquid to leave the chamber thereby, operating means to deform the flexible member from an initial condition said operating means comprising a rigid operating link extending between the flexible member and a manually engageable operating member and resilient biasing means to return the flexible member towards the initial condition to vary the volume of the pumping chamber to pump liquid into and out of the chamber wherein the resilient biasing means comprises a fluid containig unit in which relative movement of solid elements of the unit occuring on movement of the flexible member from the initial condition is resisted by elastic deformation of the fluid and the resultant energy stored in the fluid causes movement of the solid elements to move the flexible member towards the initial condition and said resilient biasing means being disposed telescopically relative to said operating link and partially within said pumping chamber.

14. A pump comprising a flexible member defining at least part of a variable volume pumping chamber, an inlet valve to permit liquid to enter the chamber thereby, an outlet valve to permit liquid to leave the chamber thereby and operating means to deform the flexible member to vary the volume of the pumping chamber to pump liquid into and out of the chamber wherein a guide means is provided to guide the flexible member during said deformation, the guide means comprising first and second slidably related members, a first of said members being located relative to a base part of the pump to which the flexible member is also attached at one end and the operating means and the other end of the flexible member being connected to the second member, said first of said members being disposed telescopically relative to said operative link and partially within said pumping chamber.

15. A pump according to claim 14 wherein said operating means includes a rigid operating link extending between said operating member and said flexible member and resilient biasing means to return the flexible member towards an initial condition, the resilient biasing means comprising a fluid containing unit having first and second slidably related solid members, relative movement therebetween on movement of the flexible member from the initial condition by the operating link being resisted by elastic deformation of the fluid and the resultant energy stored in the fluid causing movement of the first and second members to move the flexible member towards the initial condition, and the first and of said members being located relative to a base part of the pump to which a bottom end of the flexible member is attached and a top end of the flexible member being connected to a bottom end of the operating link, which is connected, at a top end thereof, to the second member and said resilient biasig means being disposed telescopically relative to said operating link and partially within said pumping chamber.

16. A pump comprising a flexible member defining at least part of a variable volume pumping chamber, an inlet valve to permit liquid to enter the chamber thereby, an outlet valve to permit liquid to leave the chamber thereby and operating means to deform the flexible member to vary the volume of the pumping chamber to pump liquid into and out of the chamber wherein said operating means includes a rigid operating link extending between said operating member and said flexible member and resilient biasing means to return the flexible member towards and initial condition, the resilient biasing means comprising a fluid containing unit having first and second slidably related solid members, relative movement therebetween on movement of the flexible member from the initial condition by the operating link bein resisted by elastic deformation of the fluid and the resultant energy stored in the fluid causing movement of the first and second menbers to move the flexible member towards the initial condition, and the first of said members being located relative to a base part of the pump to which a bottom end of the flexible member is attached and a top end of the flexible member being connected to a bottom end of the operating link, which is connected, at a top end thereof, to the second member and said resilient biasing means being disposed telescopically relative to said operating link and partially within said pump chamber.

* * * * *